US007908880B2

(12) United States Patent
Fotiadis et al.

(10) Patent No.: US 7,908,880 B2
(45) Date of Patent: Mar. 22, 2011

(54) COMPRESSOR AND EVAPORATION TRAY FOR A REFRIGERATION DEVICE

(75) Inventors: Panagiotis Fotiadis, Giengen (DE); Hans Ihle, Giengen (DE); Helmut Konopa, Leipheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 811 days.

(21) Appl. No.: 10/556,256

(22) PCT Filed: May 19, 2004

(86) PCT No.: PCT/EP2004/005440

§ 371 (c)(1),
(2), (4) Date: Nov. 10, 2005

(87) PCT Pub. No.: WO2004/104500

PCT Pub. Date: Dec. 2, 2004

(65) Prior Publication Data

US 2007/0051122 A1 Mar. 8, 2007

(30) Foreign Application Priority Data

May 20, 2003 (DE) ..... 103 22 681

(51) Int. Cl.
*F25B 47/00* (2006.01)

(52) U.S. Cl. ..... 62/277; 62/291

(58) Field of Classification Search ..... 62/277, 62/279, 285, 288, 289, 291, 305; 165/46, 165/DIG. 47; 248/638
See application file for complete search history.

(56) References Cited

U.S. PATENT DOCUMENTS

| | | | | |
|---|---|---|---|---|
| 1,720,767 | A | 7/1929 | Spreen | |
| 2,315,222 | A | 3/1943 | Philipp | |
| 2,416,851 | A * | 3/1947 | Sebok | 96/337 |
| 2,758,449 | A * | 8/1956 | Wallenbrock | 62/418 |
| 4,823,558 | A * | 4/1989 | Kim, II | 62/272 |
| 4,974,421 | A * | 12/1990 | Kim, II | 62/272 |
| 5,590,541 | A * | 1/1997 | Rainwater | 62/255 |
| 5,699,677 | A * | 12/1997 | Hakala et al. | 62/291 |
| 5,881,566 | A * | 3/1999 | Shacklock et al. | 62/277 |
| 6,393,854 | B1 * | 5/2002 | Scheuer et al. | 62/277 |

FOREIGN PATENT DOCUMENTS

| | | |
|---|---|---|
| DE | 198 02 453 | 8/1999 |
| DE | 198 55 504 | 6/2000 |
| JP | 8-338680 A * | 12/1996 |

OTHER PUBLICATIONS

Abstract of JP 8-338680 A to Toimori, Nobuaki.*
International Search Report PCT/EP2004/005440.

* cited by examiner

*Primary Examiner* — Mohammad M Ali
(74) *Attorney, Agent, or Firm* — James E. Howard; Andre Pallapies

(57) ABSTRACT

A compressor for a refrigerating device including a housing and an evaporation tray mounted on the housing. The evaporation tray is formed from a sleeve-like element mounting on the housing around a partial surface of the top of the housing.

20 Claims, 3 Drawing Sheets

COMPRESSOR AND EVAPORATION TRAY FOR A REFRIGERATION DEVICE

Figure 1:
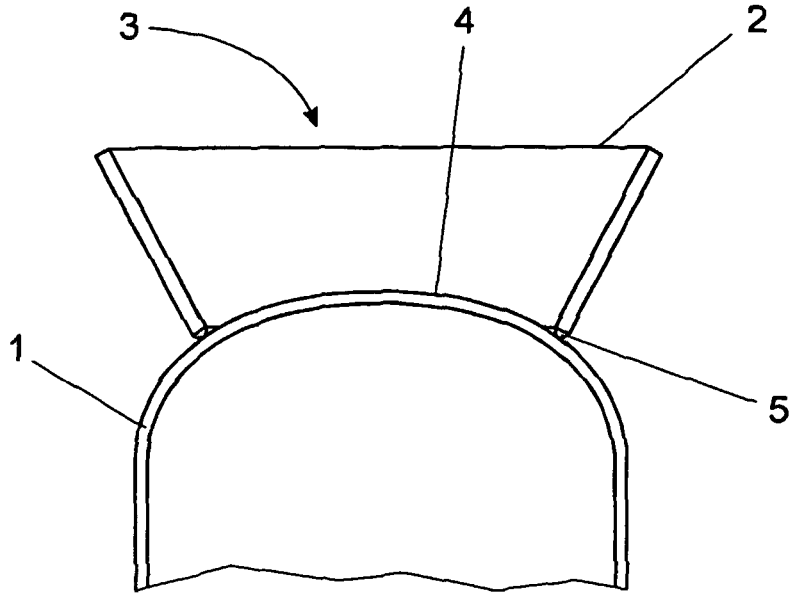

The present invention relates to a compressor with a housing and an evaporation tray for a liquid, in particular a compressor for a refrigeration device such as a refrigerator or freezer.

Moisture given off by the cool goods to the air inside the refrigerator or moisture introduced by opening of the door condenses on the evaporator in a refrigerator. This moisture must be removed from the interior of the refrigerator. For this purpose a collection gutter, which captures moisture flowing from the evaporator, is generally arranged on a wall of the interior under the evaporator. From the deepest point of the collection gutter a channel, through which the water can flow out of the interior, is guided through the housing wall of the refrigerator. This channel terminates conventionally in an open tray, in which the water can evaporate. The tray is arranged above the compressor of the refrigerator so as to heat the water with the waste heat of the compressor and thus accelerate its evaporation.

Such an evaporation tray must have sufficient power to evaporate the accumulating condensation water under any operating conditions, since overflowing of the tray could lead to water reaching live components of the compressor or its environment. The tray must therefore be arranged as close as possible to the compressor to achieve sufficient warming, ensuring that the tray does not overflow during operation and water does not flow onto the compressor. To achieve proximity which is so close and uniform from device to device in serial production between compressor and evaporation tray, the tray is generally not mounted on housing parts of the refrigeration devices, but directly on the compressor.

DE 198 55 504 A1 discloses e.g. a collecting tray, whereby the attempt is made to produce the largest possible conductive contact between the collecting tray and the housing of the compressor. For this purpose a floor of the collecting tray is formed at least in sections from a heat-conducting and loosely pliable material, in particular a film made of plastic or metal, which can be positioned at least approximately on the surface of the compressor.

The disadvantage with the illustrated embodiment however is the minimal mechanical load-carrying capacity of the film. Any damage to the film renders the evaporation tray not hermetic and thus unusable for further use. In addition to this, it often becomes impossible to bring the film into inner contact with the compressor desirable for efficient heat transfer. Air pockets between film and compressor, in particular in the vicinity of projections or depressions of the compressor housing or on folds of the film, substantially impair heat transfer. The evaporation efficiency of the known evaporation tray can thus disperse extensively, whereby the tray must be constructed for large-scale evaporation efficiency.

The object of the present invention is to provide a compressor with an evaporation tray, with which the abovementioned disadvantages can be circumvented.

This task is solved by a compressor having the features of claim 1.

The inventive compressor proves to be particularly advantageous because liquid trapped in the evaporation tray over the part surface of the housing is in direct contact with the housing of the compressor, so that heat put out by the compressor is transferred directly to the liquid to be evaporated. The heat conductive resistance between compressor and liquid is thus reduced to he least possible value. The result for the evaporation tray is clearly increased evaporation efficiency. To the same extent as the evaporation efficiency of the evaporation tray is increased, cooling for the compressor becomes more effective, i.e. the cooling efficiency for the compressor is boosted.

The element is variable for different design types of the compressor, since it can be fitted onto all current series of compressors by means of only a few support members. The clips or threaded pins necessary in known evaporation trays, which have to be welded onto the compressor to be attached, are omitted. Finally, in the case of the invention noises arising from vibrations of the refrigeration device, and which are frequently found to be disturbing, are either minimised or respectively eliminated.

In a preferred configuration of the invention the part surface is at least a part of a floor of the evaporation tray, so that in the simplest case the element can be set on a housing roof of the compressor.

To prevent any leaks from the evaporation tray at a point between the element and the housing, particularly advantageous sealing means for sealing the evaporation tray are provided at this point.

The sealing means can be e.g. a sealing ring, which can be mounted rotationally between the element and the housing on a side surface of the housing or can be placed on support members arranged on the housing.

In another embodiment the sealing means are a cold shrink-fit sleeve, which is shrink-fitted partly on the evaporation tray and partly on the housing. The configuration with a shrink-fit sleeve or any other fitted sealing connection of the housing and the element are omitted for various adapted injection moulding dies for the evaporation tray necessary to series of compressors.

Also, the sealing means can be an adhesive, by which the element is stuck to the housing.

It is also possible to have the sealing means moulded onto the evaporation tray.

The sealing means and the evaporation tray are designed particularly advantageously in one piece, since they can then be made in a single work process as one moulded item.

Owing to its durable flexibility and heat resistance silicon is preferred as material for the sealing means.

In a further development of the invention the element is pressed by a pipe clamp onto the container. This provides both for a secure hold on the element and also improves the sealing of the evaporation tray, in particular in those cases where sealing means are located between the element and the housing.

The housing can have an encircling collar, on which the element rests.

In particular in such cases where the housing is made up of two parts connected by an encircling seam, this seam can be used as a collar for placing on the element.

Figure 2:
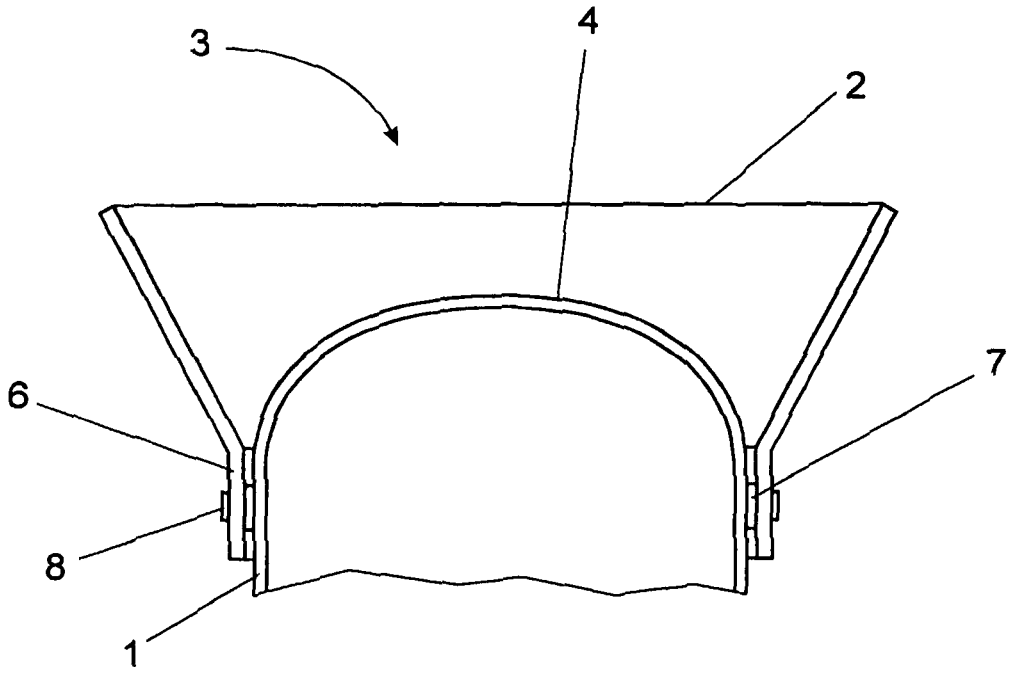
Figure 3:
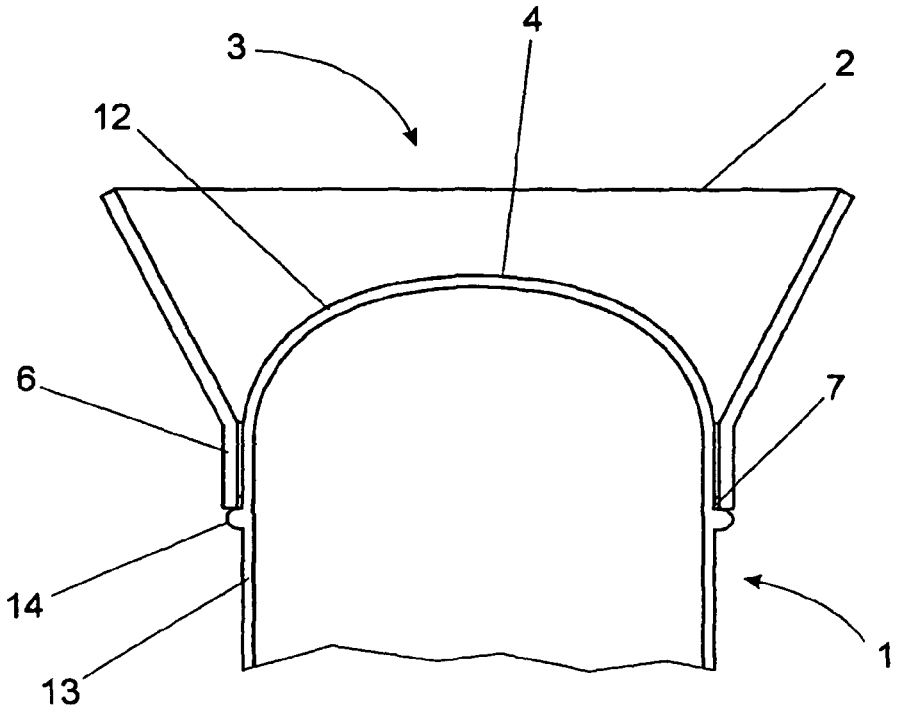
Figure 4:
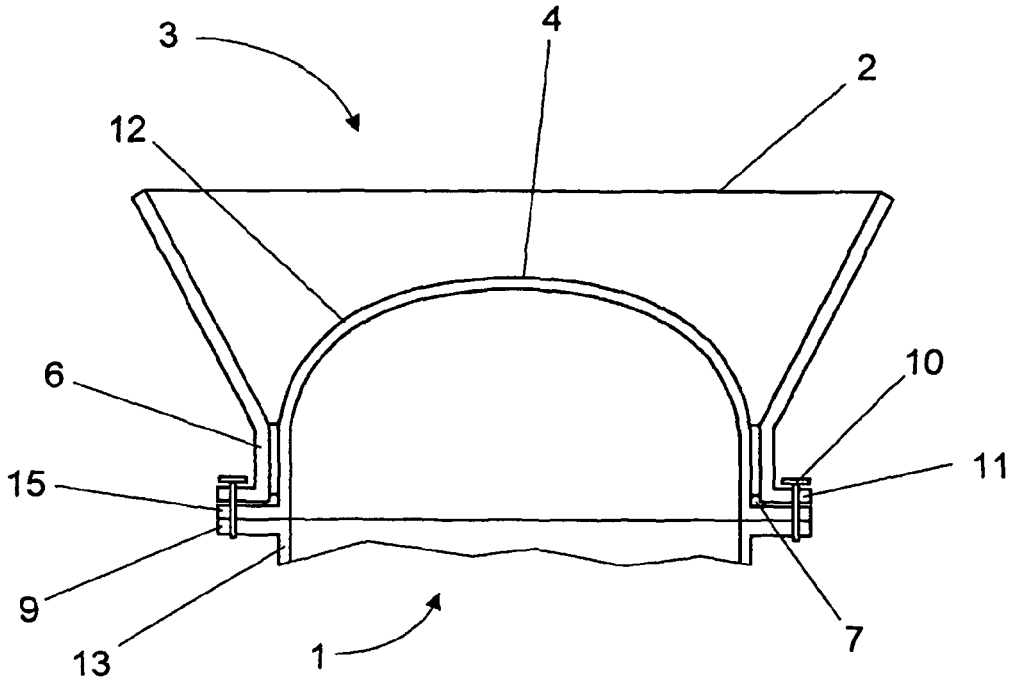

Various embodiments of the invention are illustrated hereinbelow in the figures, in which:

FIG. 1 shows a cross-section through a first embodiment of the invention;

FIG. 2 a cross-section through a second embodiment of the invention;

FIG. 3 a cross-section through a third embodiment of the invention;

FIG. 4 a cross-section through a fourth embodiment of the invention; and

Figure 5:
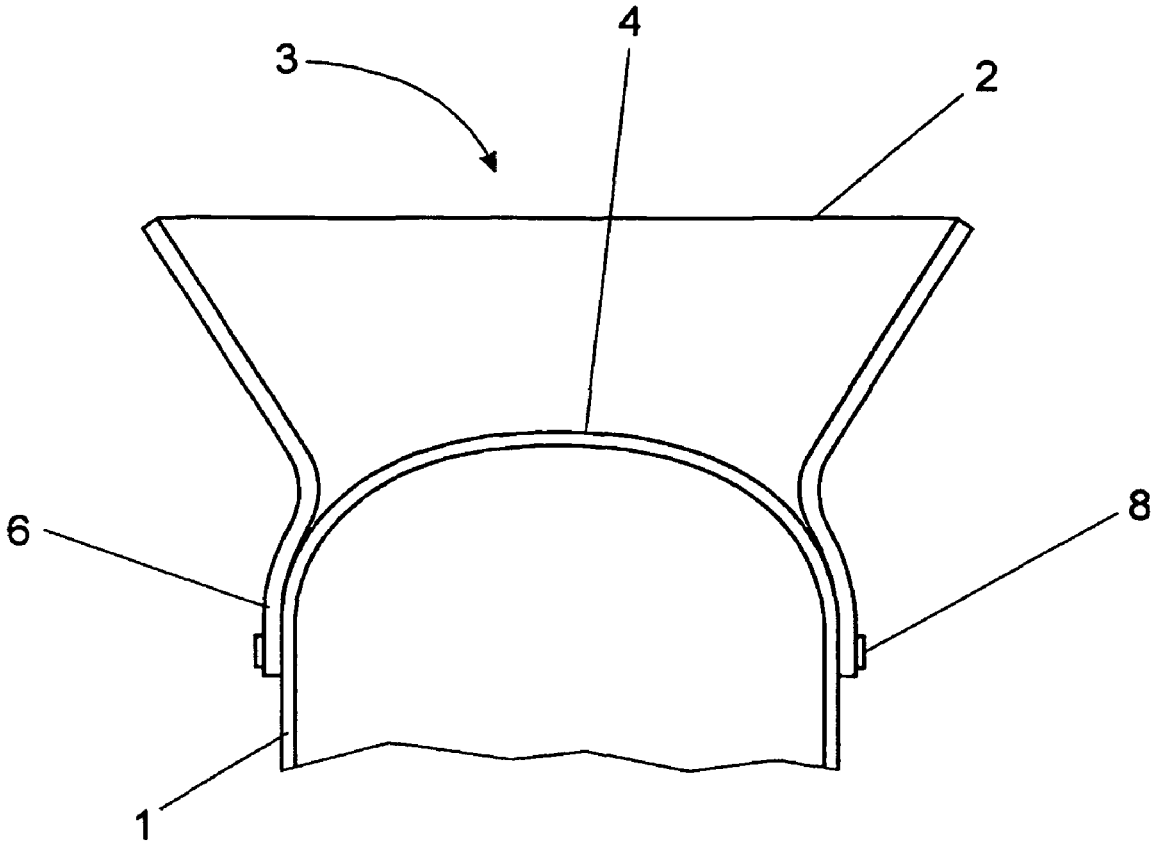

FIG. 5 a cross-section through a fifth embodiment of the invention.

A first configuration of the invention is shown in FIG. 1. Evident here is a cross-section through an upper part of a housing 1 of a compressor for a refrigerator or a freezer. The housing 1 is closed upwards in the form of a dome. An element 2 in the form of a wall of a truncated cone is set on the dome of the housing 1 such that is widens out downwards like a funnel. The lower, narrower edge of the element 2 is stuck and sealed by an annular band 5 of silicon on the dome.

In the illustrated arrangement of housing 1 and element 2 a collecting tray 3 is formed by the walls of the element 2 inclined obliquely outwards and a part surface 4 of the dome of the housing 1 enclosed by the element 2. In the evaporation tray 3, condensation occurring in the refrigerator is captured. This is collected on the floor of the collecting tray 3, where it is in direct contact with the part surface 4 of the housing 1. In this way heat generated in the compressor is transferred very efficiently via the part surface 4 directly to the water located in the collecting tray 3. Because the water evaporates without interruption, there is no large quantity of water gathering in the collecting tray 3, which can therefore be kept small. Cooling of the compressor made highly effective by direct contact with the water prolongs its service life. Also, it lowers the temperature at which the coolant exits from the compressor, so that for a condenser of the refrigeration device less output and as a result smaller dimensions are sufficient, than is the case through use of a conventional evaporation tray.

A further development of the element 2 shown in FIG. 1 is illustrated in FIG. 2. According to the illustrated further development the truncated element 2 runs at its lower narrower end into a hollow cylindrical base 6. With the base 6 the element 2 is reverse-drawn via the housing 1. At the same time a sealing ring 7 is provided mounted on the housing 1 between the base 6 and the housing 1. From the outside the base 6 is enclosed and squeezed at the level of the sealing ring 7 by a pipe clamp 8. With this configuration the part surface 4 contributing to the evaporation tray 3 is enlarged, whereby the evaporation efficiency of the evaporation tray is raised, and the connection between housing 1 and element 2 is robust and capable of bearing.

In FIG. 3 the housing 1 is composed of an upper housing part 12 and a lower housing part 13, welded together, producing a collar 14 encircling the housing 1 annularly. An element 2 with base 6 is set on the upper housing part 12, whereby the collar 14 is utilised to advantage as a stop for the element 2. With this configuration also a sealing ring 7 is provided between the element 2 and the upper housing part 12.

In the configuration shown in FIG. 4 the housing 1 is also composed of an upper housing part 12 and a lower housing part 13. The housing part 12 is mounted on the lower housing part 13. At their end both housing parts 12 and 13 include annularly angled end sections 9 and 15, which are brought together. At its lower end the base 6 of the element 2 here has a fastening ring 11 corresponding to the end sections 9 and 15, which likewise projects laterally. Through the fastening ring 11 and the end sections 9 and 15 screws 10 are fed, with which the element 2 is screwed firmly and tightly to the housing 1. Here, too, a sealing ring 7 resting on the housing 1 is provided between the element 2 and the housing 1.

An example of the latter embodiment of the invention shown in FIG. 5 is an element 2, which similarly to the element 2 is formed from a truncated part and a hollow cylindrical base 6 as in FIGS. 2-4. In contrast to the previously shown examples the element 2 however is made of an elastic material. At the same time the diameter of the base 6 is slightly less than the diameter of the housing 1, however large enough for the base 6 to be drawn onto the housing 1 in the manner shown in FIG. 5, owing to its elastic properties. Likewise because of the elastic properties the base 6 presses automatically onto the housing 1.

Despite this however a pipe clamp 8 is also provided, which sits around the base 6 and in addition presses the latter onto the housing 1. The advantage of this configuration is that additional sealing means, such as e.g. a sealing ring can be dispensed with, since the base 6 of the element 2 itself constitutes such sealing means.

The invention claimed is:

1. A compressor for a refrigeration device, the compressor comprising:

a housing having a top; and an element attached to the housing and having side walls that extend upward above the top of the housing, wherein the top of the housing and the element form an evaporation tray for holding a liquid, and the evaporation tray is configured such that the top of the housing is for coming in direct contact with the liquid.

2. The compressor according to claim 1, further comprising a seal for sealing the element against the housing.

3. The compressor according to claim 2, wherein the seal includes a sealing ring arranged between the element and the housing.

4. The compressor according to claim 3, wherein the element bears on the sealing ring.

5. The compressor according to claim 2, wherein the seal is a sealing lip encircling a side of the element.

6. The compressor according to claim 3, wherein the element is formed directly on the sealing ring in one piece.

7. The compressor according to claim 2, wherein the seal is molded onto the element.

8. The compressor according to claim 2, wherein the seal includes a cold shrinkable sleeve, which is in part shrink-fitted onto the element and in part shrink-fitted onto the housing.

9. The compressor according to claim 2, wherein the seal includes an adhesive.

10. The compressor according to claim 2, wherein the seal is made of silicon.

11. The compressor according to claim 1, further comprising a pipe clamp, by which the element is fixed on the housing.

12. The compressor according to claim 1, further comprising an encircling collar formed on the housing on which an end of the element rests.

13. The compressor according to claim 12, wherein the housing is made from two parts, an upper housing part and a lower housing part, and the collar is made from a seam on a connecting point between the upper housing part and the lower housing part.

14. The compressor according to claim 1, wherein the element is formed as a sleeve.

15. The compressor according to claim 1, wherein the element is supported exclusively by the housing.

16. The compressor according to claim 2, wherein the element is supported exclusively by the housing.

17. The compressor according to claim 6, wherein the element is supported exclusively by the housing.

18. The compressor according to claim 12, wherein the element is supported exclusively by the housing.

19. A compressor for a refrigeration device, the compressor comprising:

a housing, the housing having a top surface, a portion of the surface; and an evaporation tray for holding a liquid;

the evaporation tray being formed from the top surface of the housing and an element forming a closed loop wall, the element being mounted on the housing such that the top surface of the housing and the element together form a structure in which the liquid can be directly retained with the forming at least a portion of a floor of the evaporation tray and the closed loop wall of the element forming an arrangement rising from the floor of the evaporation tray, wherein the element is joined to the housing with no structure positioned intermediate the element and the top surface of the housing.

20. The compressor according to claim 19, wherein the element is supported exclusively by the housing.

* * * * *